US005214804A

United States Patent [19]

Carey et al.

[11] Patent Number: 5,214,804

[45] Date of Patent: Jun. 1, 1993

[54] PROTECTIVE MASK WITH SCARF

[76] Inventors: Michael J. Carey, 6817 Elaine Way, San Diego, Calif. 92120; Joseph H. Edwards, 3513 E. Danish Rd., Salt Lake City, Utah 84096

[21] Appl. No.: 826,083

[22] Filed: Jan. 27, 1992

[51] Int. Cl.[5] ..... A41D 13/00

[52] U.S. Cl. ..... 2/206; 2/9; 2/207; 2/203; 2/171; 2/173

[58] Field of Search ..... 2/206, 207, 203, 204, 2/205, 174, 171, 173, 9

[56] References Cited

U.S. PATENT DOCUMENTS

| | | | |
|---|---|---|---|
| 731,135 | 6/1903 | Scott . | |
| 766,963 | 8/1904 | Murray | 2/206 |
| 772,148 | 10/1904 | Hughes | 2/206 |
| 805,052 | 11/1905 | Brooks | 2/206 |
| 891,122 | 6/1908 | Wilcox . | |
| 1,309,783 | 7/1919 | Slawin . | |
| 1,990,199 | 2/1935 | Nemzek | 2/206 |
| 2,276,612 | 3/1942 | Ellis . | |
| 2,353,025 | 7/1944 | Gautreaux | 2/206 |
| 2,716,981 | 9/1955 | More | 2/206 |
| 3,740,767 | 6/1973 | Schuessler | 2/173 |
| 3,878,563 | 4/1975 | Pulju | 2/9 |
| 3,943,575 | 3/1976 | Bolker | 2/205 |
| 4,095,290 | 6/1978 | O'Brien | 2/9 |
| 4,250,577 | 2/1981 | Smith . | |
| 4,259,748 | 4/1981 | Miller . | |
| 4,300,240 | 11/1981 | Edwards . | |
| 4,641,379 | 2/1987 | Martin | 2/206 |
| 4,825,474 | 5/1989 | Edwards | 2/206 |
| 4,941,211 | 7/1990 | Blustein | 2/206 |
| 5,035,006 | 7/1991 | Hetz et al. | 2/206 |

FOREIGN PATENT DOCUMENTS

| | | | |
|---|---|---|---|
| 386828 | 11/1922 | Austria | 2/206 |

*Primary Examiner*—Clifford D. Crowder
*Assistant Examiner*—G. Hale
*Attorney, Agent, or Firm*—Trask, Britt & Rossa

[57] ABSTRACT

An article of clothing includes a mask member and a scarf member joined together. The mask is formed of a closed-cell neoprene with a fleece interior lining and a Lycra TM exterior surface. A scarf member is secured to the lower edge of the mask member to extend rearwardly about the head of the user and is made of a fleece material. The article of clothing is held in place about the head and neck of the user by VELCRO TM fasteners.

19 Claims, 2 Drawing Sheets

PROTECTIVE MASK WITH SCARF

BACKGROUND OF THE INVENTION

1. Field

This invention relates to articles of clothing and more particularly to a protective mask with a scarf combined therewith.

2. State of the Art

Masks have been used in the past to protect a user's face from inclement weather. For example, U.S. Pat. No. 4,300,240 (Edwards) discloses a closed cell neoprene mask which may be worn about the face to protect the user from adverse weather including wind, cold, rain, snow and the like.

Other articles of clothing have been devised to protect the face from inclement weather. For example, U.S. Pat. No. 766,963 (Murray) shows a muffler structure which is wrapped about the lower portion of the face. The muffler has extensions which wrap behind the head and extend forwardly for tieing a knot under the chin. U.S. Pat. No. 731,135 (Scott) shows a neck and ear muffler preferably formed of a single piece and of a knitted fabric.

Other face protecting devices have been disclosed for protecting the face for purposes other than adverse weather. For example, U.S. Pat. No. 2,276,612 (Ellis) shows a face guard to protect infants. U.S. Pat. No. 2,716,981 (Moore) shows a mask to protect the face of a person using a hair dryer. Similarly, U.S. Pat. No. 4,259,748 (Miller) shows a moisture-absorbent mask for covering the face, neck and ears. Other protective masks are disclosed in U.S. Pat. No. 1,309,783 (Slawin), U.S. Pat. No. 3,878,563 (Pulgin) and U.S. Pat. No. 4,250,577 (Smith).

Masks heretofore disclosed do not teach construction of an article of clothing to effectively protect both the face and the neck suitable for use while performing physical activities including sports in an adverse weather environment including specifically a cold weather environment.

SUMMARY OF THE INVENTION

An article of clothing includes a mask member which is sized and shaped to fit about the face. The mask member has an upper edge which extends along the lower part of the eye socket areas of the user and contouredly over the nose. The mask member also has a lower edge which extends under the chin and upwardly toward the upper edge on both sides of the face rearward of the eye socket areas.

A scarf member is secured to the mask member along the lower edge. The scarf member is sized to extend downwardly from the lower edge substantially the height of the neck. The scarf member extends in width rearwardly about the neck on both sides of the head. Securing means are associated with the scarf member to secure the article of clothing about the head of the user and preferably behind the head of the user.

In an alternate arrangement, the upper edge of the mask member extends rearwardly to the area of the temples. The lower edge of the mask member is arcuate and intersects the upper edge in the area of the temples. Preferably the scarf member extends from the lower edge at the temple area rearwardly about the head of the user.

More preferably, the scarf member has an upper edge which is in general alignment with the upper edge of the mask member. Preferably the scarf member extends in height from the upper edge downwardly toward the shoulders of the user rearwardly of the temple area.

In preferred arrangements, the mask member of the article of clothing is made of a stretchable material. More preferably, the mask member is made of a multi-layered material with a fleece interior layer and a water-resistant exterior layer. Preferably the mask member is a closed-cell neoprene material with an internal fleece layer laminated thereto. Preferably the closed-cell neoprene material also has an external water-resistant material laminated thereto.

In yet another arrangement, the scarf member i s desirably made of a soft, stretchable material. More preferably, the scarf member is made of fleece-like material.

In an alternate configuration, the mask member has a middle edge formed therein for positioning under the user's nose and sized to extend substantially the width of the user's nose. The mask member desirably has a nose member formed to extend outwardly to accommodate the user's nose above the middle edge. The mask member also has a front edge extending from the middle edge downwardly towards the user's chin. The front edge so formed is desirably arcuate in projection. The mask is formed so that the lower edge fits snugly under the chin. The front edge is shaped to alternately and selectively form a pocket proximate the lips as desired by the user in positioning the mask member about the user's face. The mask is formed so that the lower edge fits under the chin.

In a preferred structure, the upper edge has piping affixed thereto and therealong. In yet another preferred structure, the scarf member has a left portion extending rearwardly about the left side of the head of the user and a right portion extending rearwardly about the right side of the head of the user. The securing means are preferably co-acting fasteners secured to the left portion and the right portion of the scarf member. In the preferred arrangements, the securing means are co-acting VELCRO TM fasteners.

BRIEF DESCRIPTION OF THE DRAWINGS

In the drawings which illustrate what is presently regarded as the best mode for carrying out the invention.

DESCRIPTION OF THE ILLUSTRATED EMBODIMENT

Figure 1:
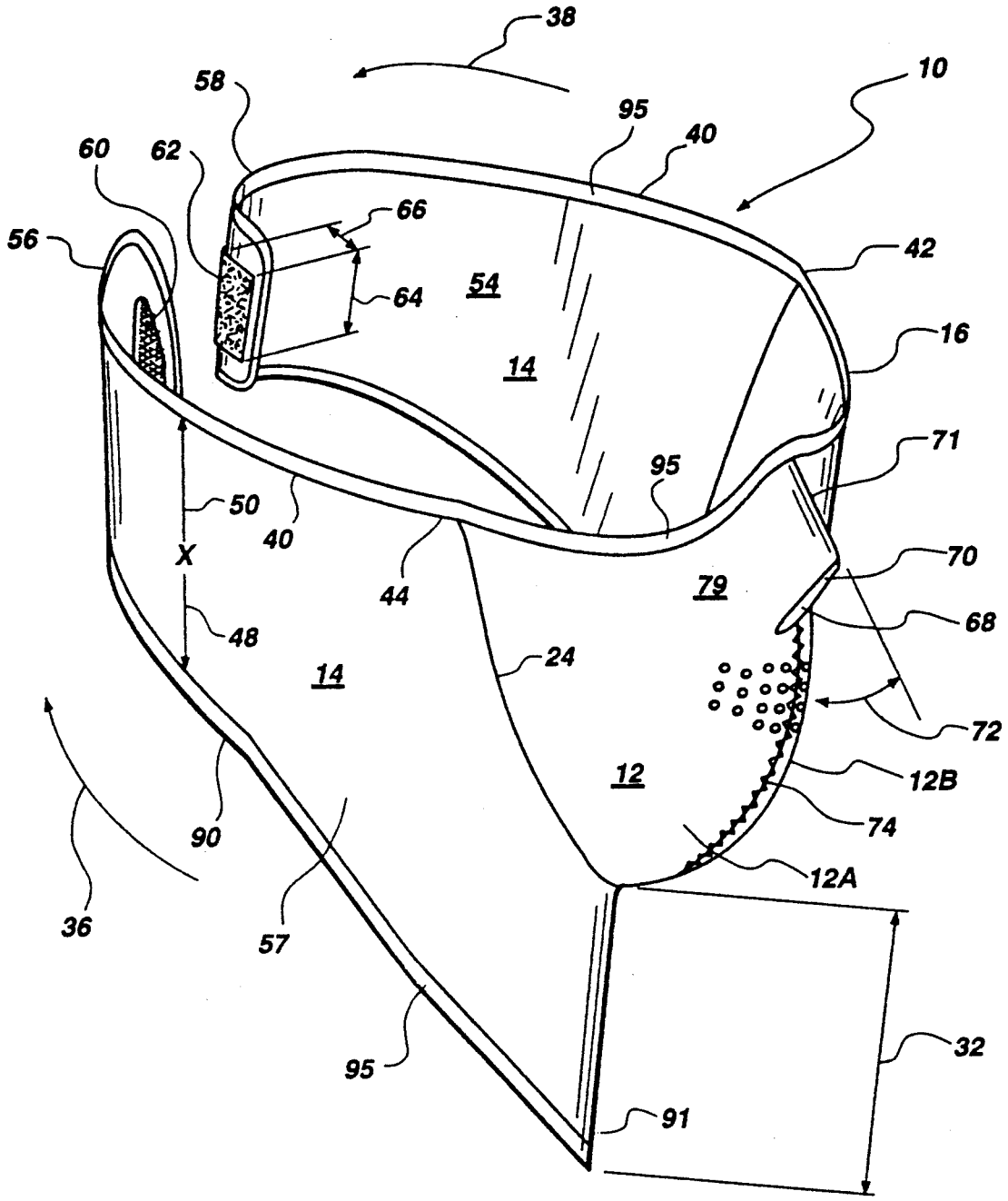
FIG. 1 is a perspective view of an article of clothing of the instant invention.
Figure 2:
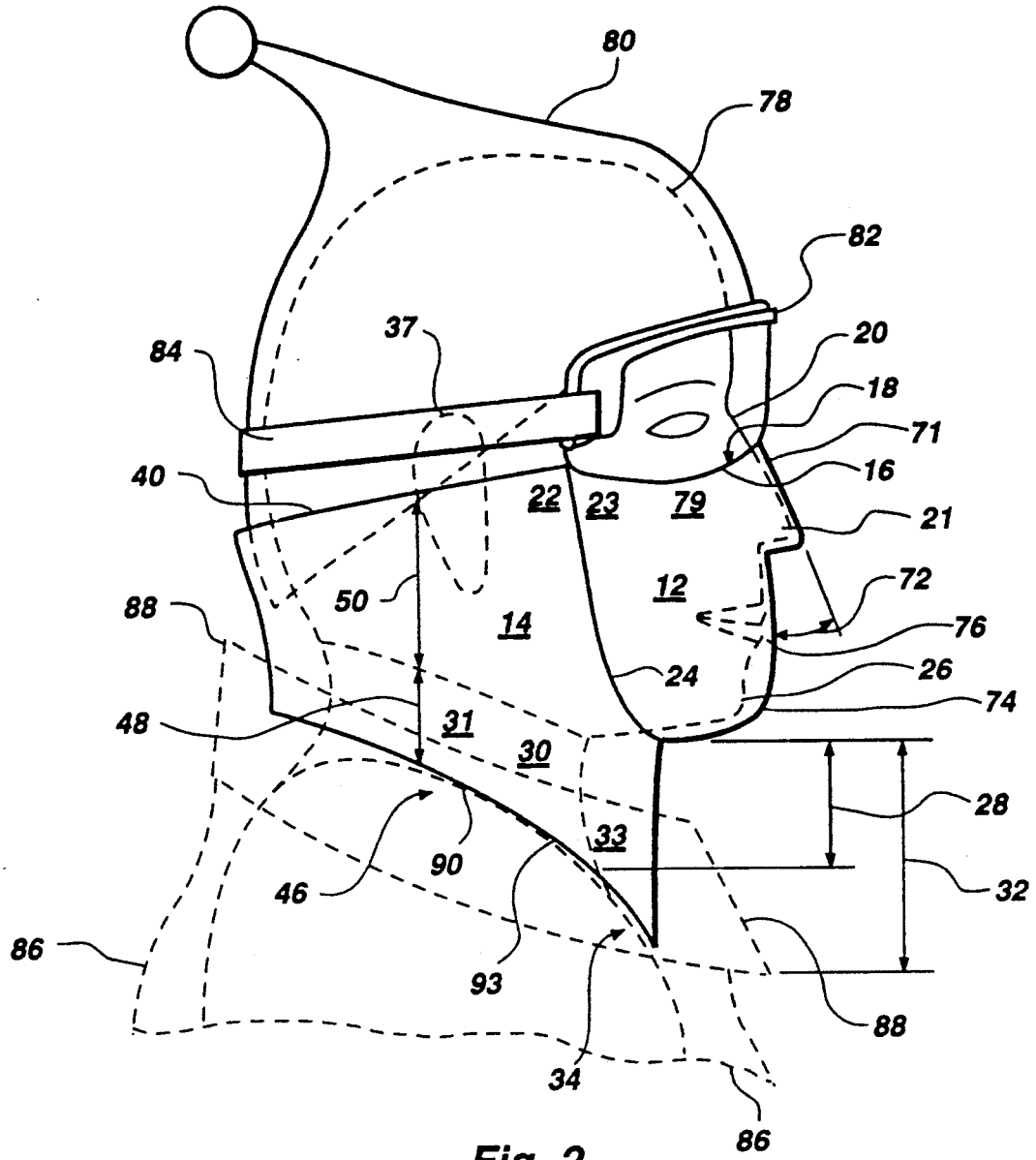
FIG. 2 is a side view of an article of clothing of the instant invention positioned on a user shown in phantom.

In FIGS. 1 and 2, the article of clothing 10 has a protective mask member 12 in combination with a scarf member 14 to form a single article of clothing. The mask member 12 is attached to and combined with the scarf member 14. The mask member 12 is sized and shaped to fit about the face of the user as best seen in FIG. 2. The mask member 12 has an upper edge 16 which is formed to extend along the lower portion of the eye socket areas 18 and over the bridge 20 of the nose 21. More specifically, the mask member 12 is shaped to extend contouredly along the upper portion of the cheek bone area 23 and along the bottom of the eye socket areas 18 and over the bridge 20 of the nose 21.

The mask member 12 also has a lower edge 24 which extends under the chin 26 and upwardly toward the upper edge 16 on both sides of the face rearward of the eye socket areas 18. As here shown, the mask member 12 and the scarf member 14 are secured to each other along the lower edge 24 to form a single article of clothing. It can also be seen that the lower edge 24 of the mask member 12 is also arcuate in shape as it extends upwardly from under the chin 26 toward the area of the temples 22.

Figure 3:
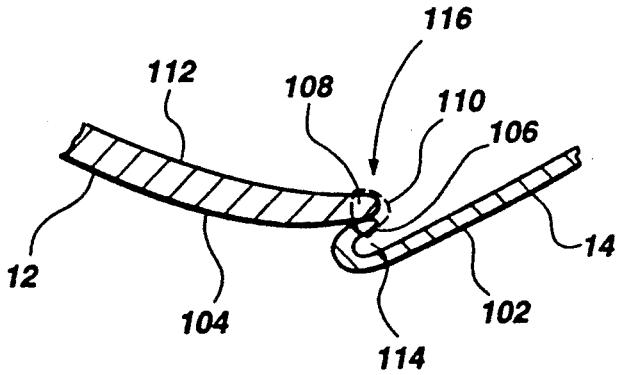
FIG. 3 is a partial cross-section of a portion of the article of clothing of the instant invention.

As shown in FIG. 3, the mask member 12 of this embodiment is formed of a thicker material which is more rigid than the material from which the scarf member 14 is formed. To secure the scarf member 14 to the mask member 12, the outside or front 102 of the scarf member 14 is positioned on the front 104 of the mask member 12. The ends 106 and 108 are positioned proximate each other or in general alignment. The securement is then effected by stitching the ends 106 and 108 together with thread 110. The ends 106 and 108 are preferably secured by over-stitching to compress the ends 106 and 108 to minimize the thickness of the resulting seam 116. In turn, the interior surface 112 of the mask member 12 remains smooth so the user will not experience the discomfort of a protruding or raised seam. Further, no stitching appears on the outside or exterior 104 and 102 of the mask and scarf members to in turn present a smooth, finished appearance. The space 114 shown in FIG. 3 as the scarf member is folded to extend rearward is reduced to virtually nothing as the scarf member 14 is pulled or secured about the user's head. However, the mask member 14 is formed of material which is more pliable than the mask member 12 as aforesaid, so the stitched seam 116 is not in turn twisted or pressed into the user's skin to create discomfort in use.

The scarf member 14 is sized to extend from the lower edge 24 substantially the height 28 of the neck area 30. Preferably the scarf member 14 is sized in height 32 in the area under the user's chin 26 to extend from the lower edge 24 down into contact with the chest area 34 of the user. As stated, the scarf member 14 extends rearwardly 36 and 38 on both sides of the head 78. Although in some embodiments it may be acceptable for the scarf member 14 to extend rearwardly 36 and 38 only to a point proximate the ears 37 of the user, the illustrated embodiment is preferred with the scarf member 14 extending rearwardly about the head 78 and neck 31 of the user. That is, the scarf member 14 extends rearwardly 36 and 38 from the lower edge 24 at the temple area 22 to surround the neck 81 and lower portion of the head 78 of the user.

As can be seen, the scarf member 14 has an upper edge 40 which is here shown in alignment with the upper edge 16 of the mask member 12. The upper edge 16 of the mask member 12 is arcuate from the eye socket areas 18 toward the temple areas 22 and extend generally upward as shown as the upper edge 16 approaches intersection with the lower edge 24. The upper edge 16 of the mask member 12 thus forms a small point 42 on the left side of the head and a small point 44 on the right side of the head, both in the vicinity of the temple areas 22. The upper edge 40 of the scarf member 16 extends rearwardly from the points 42 and 44.

As best seen in FIG. 2, the scarf member 14 is here shown to extend in height from the upper edge 40 downwardly to the area 30 of the neck 31 and further downwardly toward the shoulder 46 of the user in the region rearwardly of the temple area 22. Although the scarf member 14 may be formed so that height 48 is substantially the height of the neck 31 as the scarf member 14 extends rearwardly about the head, the embodiment here illustrated preferably has an additional height 50 so that the scarf member 14 extends essentially between contact with the shoulder area 46 upwardly to proximate the middle of the user's ears 37. In other configurations the scarf member 14 may extend to under the ear 37 or over the ear 37. In yet other configurations the mask member 12 may extend rearwardly to or over the ear 37 with the scarf member extending downwardly therefrom.

The articles of clothing 10 may be provided in different sizes (e.g., small, medium, large and extra large) for users of different sizes. Further, the articles of clothing can be provided in children, women's and men's sizes to further accommodate for varying dimensions. However sized, the heights 32, 48 and 50 of the scarf member 14 are selected to extend essentially the height of the neck 31. That is, the height 32 in the throat area 33 is selected so the scarf member extends from the chin downwardly into contact in the chest area 34. It may be several inches longer (e.g. 1 to 2 inches) or shorter without detracting from the effectiveness of the scarf member 14 because the scarf member 14 may be held in place by a jacket collar 88. Similarly, the height 48 in the area rearward of the temples 22 is selected to extend substantially or essentially the height 28 of the neck 31 and preferably an additional height 50. The total height may be several inches longer (e.g. 1 to 2 inches) without creating uncomfortable bunching of material in the shoulder area 46 or several inches shorter (e.g. 1 to 2 inches), without detracting from the effectiveness of the scarf member 14 as it may also be held in place by the collar 88 of the user's jacket 86 or a similar outer garment.

As here shown, the mask member 14 is preferably formed of an insulating material suitable for placement upon and proximate the skin of the user. More specifically, the embodiment here illustrated employs a POLAR TEC TM fleece-type material which may be obtained from Malden Mills Industries, Inc., P.O. Box 809, Lawrence, Mass. 04842. The material presents the user with a smooth and fuzzy surface to facilitate the feeling of warmth and comfort. Such material is very pliable or flexible and in turn minimizes any adverse wear or friction that might come from other less flexible or smooth materials which could create discomfort during periods of high activity such as that associated with downhill snow skiing or cross-country skiing.

As best seen in FIG. 1, the scarf member 14 is formed to have a right portion 52 and a left portion 54. Each portion 52 and 54 extend rearwardly 36 and 38 about the head 78 of the user. The distal ends 56 and 58 have fastening means associated therewith. Although a variety of snaps, strings or other fastening devices may be used, the embodiment here illustrated employs VELCRO TM fastening members 60 and 62. As known, the VELCRO TM fasteners are hook and pile structures which are sized in height 64 and in width 66 to provide adjustability for the user in positioning the article of clothing 10 about the user's head. More specifically, the co-acting fasteners 60 and 62 provide the user with the opportunity to adjust the fit of the article of clothing 10 about the user's head as the user prefers. The article of clothing 10 may be secured snugly or less snugly as desired. With the article of clothing 10 pulled very snugly or tightly about the head 78, the user may experience some discomfort as the mask member is pressed inward against the user's lips. With the mask member 12 positioned more loosely about the head 78, the front edge 74 of the member 12 mask will form a pocket 76 to accommodate the user's lips as more fully discussed hereinafter. Upon installation, the user may also pull the article of clothing 10 and in turn the mask member 12 rearwardly about the face to bring the upper edge 16 of the mask member 12 into a snug fit over the bridge 20 of the nose 21 and along the lower portion of the eye socket areas 18 toward the temple region 22 of the user.

The mask member 12 is here preferably selected to be a multi-layer material with a fleece interior layer and a water-resistant exterior layer. More specifically, the mask member 12 is preferably a closed-cell neoprene with an internal fleece layer laminated thereto. An external water-resistant material is preferably also laminated thereto. A desired material for the exterior surface is Lycra TM, which provides for a smooth, yet elastic exterior surface that enhances the wind resistance capability of the mask as well as the water resistance capability of the mask member 12. Although the material for the mask member 12 is laminated. Other materials may be used that are formed by other methods. The multi-layer material is about one eighth of an inch to about three sixteenths of an inch thick and may be obtained from RUBATEX Corp of Bedford, Va. Further, the mask member 12 may be formed of elastic like material such as that described, or closed cell neoprene, but also other non-stretchable materials in selected applications.

In the illustrated embodiment, the lower edge 24 of the mask member 12 is formed to fit snugly under the chin 26 of the user. A middle edge 68 is formed under the nose 21 of the user to extend substantially the width of the nose. An aperture 70 is formed in the mask member 12 above the middle edge 68. The mask member 12 is formed With a nose portion 71 at an angle 72 selected to accommodate the slant of the user's nose 21.

As here shown in FIG. 1, a stitched seam 74 extends from the middle edge 68 to the lower edge 24 to join opposite sides 12A and 12B of the mask member 12. Although a stitched seam 74 is shown, it is not required to be stitched so long as the mask has a junctional front edge or front portion which is arcuate as it extends downwardly from the area of the middle edge 68 to the area of the user's chin 26. The arcuate front edge or portion forms a pocket 76 to accommodate the user's lips as shown in FIG. 2.

Referring to FIG. 2, it can be seen that the article of clothing is positioned about the user's head 78 which is shown in phantom. A cap 80 is positioned about the head 78 along with goggles 82 which have a strap 84 extending rearwardly about the head 78. It may be noted that the lower portion of the goggles 82 is cut away and not shown. The cut away portion fits over the top 79 of the mask member 12 and more specifically over the upper edge 16.

The user also has a jacket 86 with a collar 88 shown in phantom. The collar 88 extends above the lower edge 90 of the scarf member 14. Notably, the lower edge 90 extends from the front 91 of the scarf member 14 in the throat area 33 upwardly and arcuately to approximate the arc 93 or slope from the chest area 34 to the shoulder area 46.

Also as best seen in FIG. 1, the upper edge 16 of the mask member 12 and the upper edge 40 of the scarf member as well as the lower edge 90 of the scarf member 14 all have piping material 95 secured thereto preferably by stitching. The piping may be any type of elastic-like material suitable to function as a piping. In the illustrated embodiment, the piping is made of a Lycra TM material and stitched to the edge of the scarf member 14 and the mask member 12.

Referring back to FIG. 2, as can be seen, the article of clothing 10 substantially covers the lower portion of the head 78 of a user. In association with a hat or cap 80 and a pair of goggles 82, the user may be able to substantially cover the entire face and head and protect the user against adverse weather conditions such as wind, cold including related snow, ice and the like. At the same time, the fleece material of the scarf member 14 is deformable or elastic preferably in all directions as is the mask member 12. The user may thus readily move the jaw, mouth, cheeks and other facial components. Materials which are deformable in only one axis or direction may also be used. The user may also move the head, arms and shoulders while performing strenuous exercise, such as skiing, without pulling the scarf member 14 from underneath the collar 88 of the jacket 86.

Alternately the user may snugly position the article of clothing 10 about the user's head and over related articles of clothing. The elastic characteristics of the scarf member 14 enable the user to effect a snug fit without discomfort and at the same time provide for motion so the user may readily and easily move about (e.g. work or exercise) with the article of clothing attached.

In other configurations, the mask member and the scarf member may be made of in-elastic materials. However, it is presently believed that the article of clothing 10 will be more desirable if either the scarf member 14 or the mask member is made of an elastic-like material.

The description of the illustrated embodiments are not intended to limit the scope of the claims which themselves recite those features which are regarded as essential to this invention.

We claim:

1. An article of clothing comprising:

a mask member sized and shaped to fit about the face, said mask
member having
an upper edge to extend along the lower part of the eye socket areas contouredly over the nose, and
a lower edge to extend under the chin and upwardly toward the said upper edge on both sides of the face rearward of the eye socket areas;

a scarf member secured to said mask member along said lower edge, said scarf member being sized to extend from said lower edge substantially the height of the neck of the user and in width rearwardly about the neck on both sides of the head; and securing means associated with said scarf member to secure the article of clothing about the head of the user;

wherein said upper edge extends rearwardly to the area of the temples, and wherein said lower edge is arcuate and intersects said upper edge in the area of the temples.

2. The article of clothing of claim 1 wherein said scarf member has a left side and a right side which extend rearwardly and are sized to surround the neck of the user.

3. The articles of clothing of claim 2 wherein the scarf member in the area under the chin of the user extends in height from the lower edge of the mask member to the chest area of the user.

4. An article of clothing comprising:

a mask member sized and shaped to fit about the face, said mask
member having
an upper edge to extend along the lower part of the eye socket areas contouredly over the nose, and
a lower edge to extend under the chin and upwardly toward the said upper edge on both sides of the face rearward of the eye socket areas;

a scarf member secured to said mask member along said lower edge, said scarf member being sized to extend from said lower edge substantially the height of the neck of the user and in width rearwardly about the neck on both sides of the head; and securing means associated with said scarf member to secure the article of clothing about the head of the user;

wherein said scarf member has a left side and a right side which extend rearwardly and are sized to surround the neck of the user;

wherein the scarf member in the area under the chin of the user extends in height from the lower edge of the mask member to the chest area of the user; and wherein said upper edge extends rearwardly to the area of the temples, and wherein said lower edge is arcuate and intersects said upper edge in the area of the temples.

5. The article of clothing of claim 4 wherein said scarf member extends from the lower edge at the temple area rearwardly about the head of the user.

6. The article of clothing of claim 5 wherein said scarf member has an upper edge which is in alignment with the said upper edge of said mask member.

7. The article of clothing of claim 6 wherein said left side and said right side of said scarf member extend in height from their upper edge downwardly substantially to the shoulders of the user rearwardly of the temple area.

8. The article of clothing of claim 1 wherein said mask member is made of a stretchable material.

9. The article of clothing of claim 8 wherein said mask member is multi-layered with a fleece internal layer and a water resistant exterior layer.

10. The article of clothing of claim 8 wherein said mask member is made of a closed cell neoprene material with an internal fleece layer laminated thereto and the external water resistant material laminated thereto.

11. The article of clothing of claim 1 wherein said scarf member is made of a soft stretchable material.

12. The article of clothing of claim 11 wherein said scarf member is made of a fleece-like material.

13. The article of clothing of claim 1 wherein said mask member has a middle edge forward therein for positioning under the user's nose and sized to extend substantially the width of the user's nose.

14. The article of clothing of claim 13 wherein said mask member has a front edge extending from said middle edge downwardly toward the user's chin, said front edge being formed to be arcuate when not in use.

15. The article of clothing of claim 14 wherein said mask is sized to position the lower edge snugly under the chin and said front edge is shaped to alternately and selectively form a pocket proximate the lips.

16. The article of clothing of claim 6 wherein said upper edge of said mask member and said scarf member have piping affixed thereto and there along.

17. The article of clothing of claim 2 wherein said securing means is co-acting fasteners secured to said left side and said right side of said scarf member.

18. The article of clothing of claim 17 wherein said co-acting fasteners are pile and hook fasteners.

19. The article of clothing of claim 1 wherein said mask member is made of a non-stretchable material.

* * * * *